US007422445B2

(12) United States Patent
Cheng

(10) Patent No.: US 7,422,445 B2
(45) Date of Patent: Sep. 9, 2008

(54) SINKING ELECTRICAL CARD CONNECTOR

(75) Inventor: Yung-Chang Cheng, Tu-cheng (TW)

(73) Assignee: HonHai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/906,593

(22) Filed: Oct. 2, 2007

(65) Prior Publication Data

US 2008/0096409 A1 Apr. 24, 2008

(30) Foreign Application Priority Data

Oct. 2, 2006 (TW) ..... 95217570 U

(51) Int. Cl.
*H01R 12/00* (2006.01)

(52) U.S. Cl. ..... 439/79; 439/567; 439/945; 439/947; 439/951; 439/630

(58) Field of Classification Search ..... 439/79, 439/597, 571, 945, 947, 951
See application file for complete search history.

(56) References Cited

U.S. PATENT DOCUMENTS 6,004,144 A * 12/1999 Yeh et al. ..... 439/76.1
6,129,562 A * 10/2000 Hong ..... 439/79
6,227,879 B1 * 5/2001 Dong ..... 439/92
6,461,170 B1 * 10/2002 Oliphant et al. ..... 439/76.1
6,761,566 B2 * 7/2004 Chin-Lung et al. ..... 439/76.1
7,351,108 B2 * 4/2008 Ting et al. ..... 439/630
2006/0141857 A1 6/2006 Ting
2006/0194478 A1 8/2006 Ting
2007/0141879 A1 * 6/2007 Wu ..... 439/159
2008/0096409 A1 * 4/2008 Cheng ..... 439/159

* cited by examiner

*Primary Examiner*—James Harvey
(74) *Attorney, Agent, or Firm*—Wei Te Chung

(57) ABSTRACT

A sinking electrical card connector includes an insulating housing (10) sinking partially into a hole defined on a printed circuit board (30) (PCB), a number of terminals (20) retained in the insulating housing, a shell (40) mounted on the insulating housing, wherein a pair of holding portions 120 and 120' are formed by the opposite lateral walls of the insulating housing extending outwardly, and each holding portion engages with an edge of the hole of the PCB.

16 Claims, 6 Drawing Sheets

SINKING ELECTRICAL CARD CONNECTOR

BACKGROUND OF THE INVENTION

1. Field of the Invention

The present invention relates to an electrical card connector for accessing electrical cards, such as memory cards, and more particularly to a sinking electrical card connector partially sinking into a hole provided on a Printed Circuit Board (PCB).

2. Description of Prior Arts

Memory cards are used in many applications in today's electronic society, including video cameras, smartphones, music players, ATMs, cable television decoders, toys, games, PC adapters and other electronic applications. A typical memory card includes a contact or terminal array for connecting an electrical connector to a card reader system and then to external equipment. The connector readily accommodates insertion and removal of the card to provide quick access to the information and program on the card. The card connector includes terminals for engaging the contact or terminal array of the card. U.S. Pat. No. 7,090,513, for example, discloses an electrical card connector as described above.

Such electrical card connector is usually mounted on a PCB directly. With the development of the minitype electrical equipment, a kind of sinking electrical card connector is appeared for reducing the height of the electrical card connector and taking less room. The sinking electrical card connector is partially located in a notch or hole defined on a PCB, with soldering potions of a plurality of terminals soldered on the PCB. The insulating housing is assembled with the PCB by the soldering potion soldered on the PCB, and the soldering portion is located behind a base section of the insulating housing. Relative to the base section, the suspended front portion is heavier than the back portion of the insulating housing, leading to the barycenter of the insulating housing being located in front of the base section and the soldering portion. So the insulating housing tends to deflect forwardly because of the barycenter of the insulating housing away from the soldering portion of the metallic terminals, and the terminals can not be soldered stably with the PCB. Additionally, the length of the sinking electrical card connector is so long that the soldering portions of the metallic terminals can not provide enough mounting force for the sinking electrical card connector sinking in the hole of the PCB.

It is an object of the present invention to solve the above described problems. The present invention provides a sinking electrical card connector which allows the insulating housing to be mounted on the PCB stably and firmly.

SUMMARY OF THE INVENTION

An object, therefore, of the invention is to provide a sinking electrical card connector, which can reliably make a insulating housing of the sinking electrical card connector be mounted on the PCB stably and firmly.

In the exemplary embodiment of the invention, a sinking electrical card connector includes an insulating housing sinking partially into a hole defined on a printed circuit board, a plurality of terminals retained in the insulating housing, a shell mounted on the insulating housing, wherein a pair of holding portions and are formed by the opposite lateral walls of the insulating housing extending outwardly, and each holding portion engages with an edge of the hole of the PCB.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
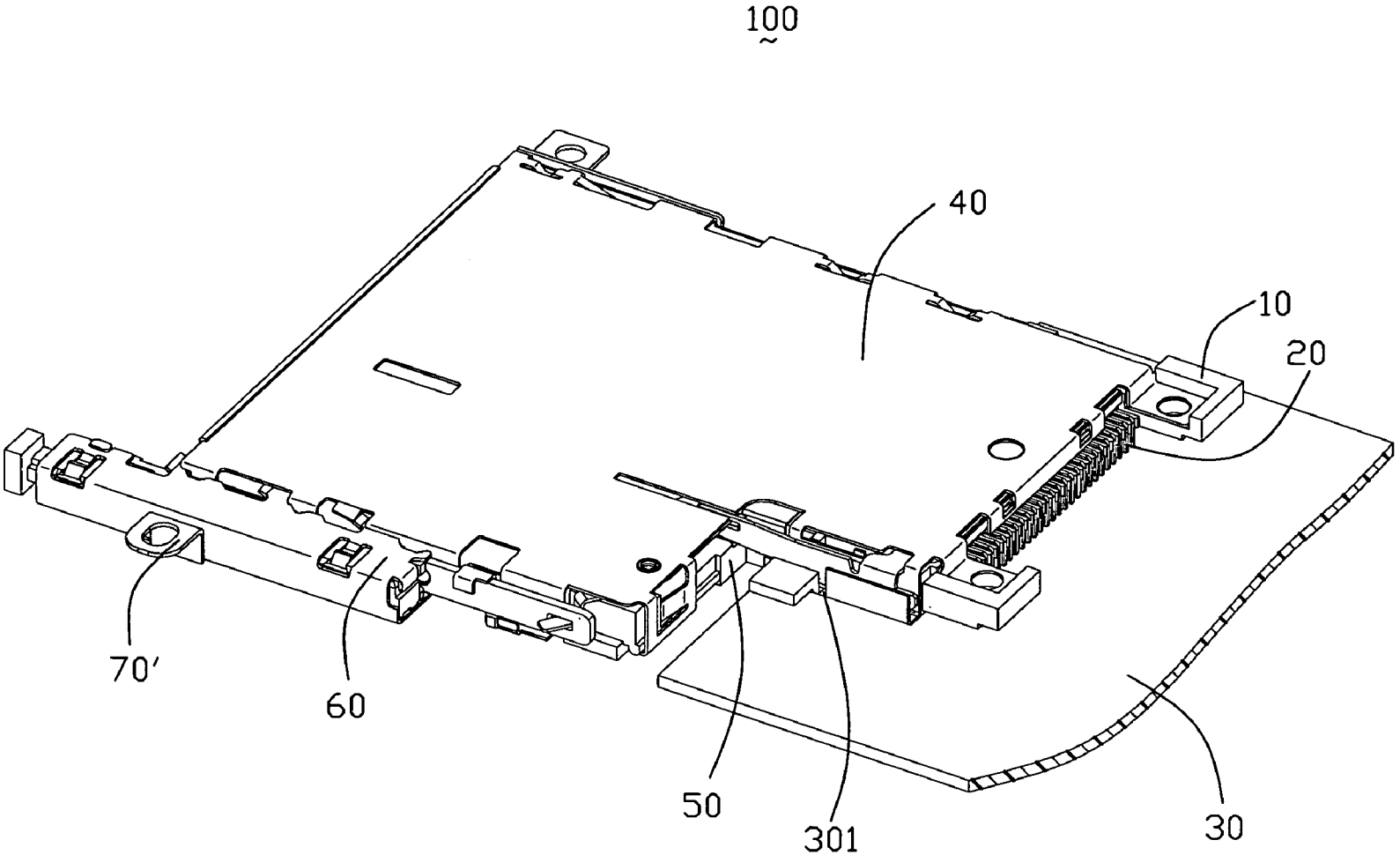
FIG. 1 is a perspective, assembly view of a sinking electrical card connector in accordance with the present invention.
Figure 2:
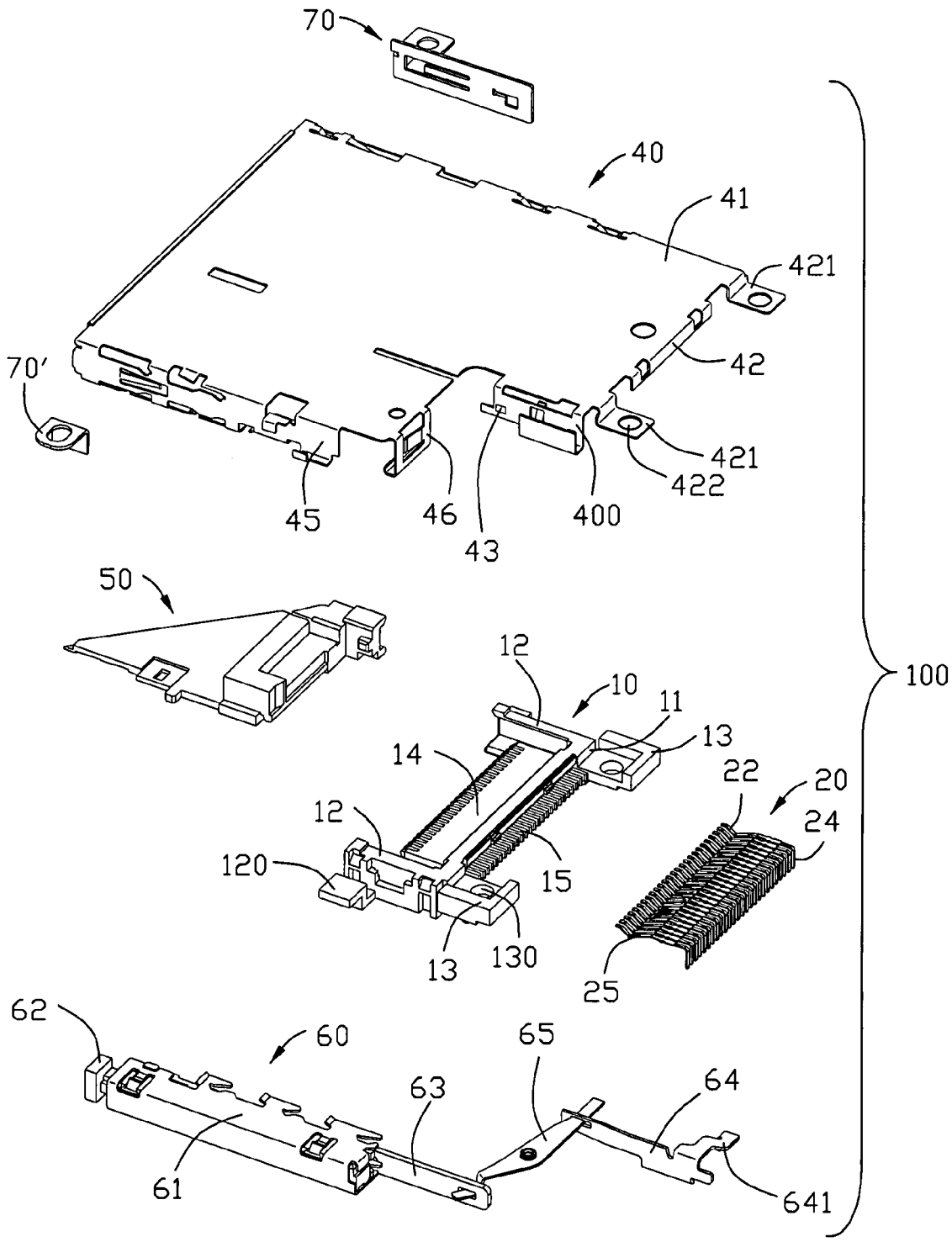
FIG. 2 is an exploded view of the sinking electrical card connector shown in FIG. 1.

Referring to the drawings in greater detail, and first to FIGS. 1 and 2, a sinking electrical card connector 100 partially sinking in a hole 301 of a Printed Circuit Board (PCB) 30 in accordance with present invention comprises a generally rectangular insulating housing 10 and a generally L-shaped shell 40 mounted on the insulating housing 10. The insulating housing 10 and the shell 40 define a receiving room (not labeled) for selectively receiving an I-shaped or L-shaped card. A guiding portion 50 is mounted in the receiving room for guiding a card inserted. An ejecting member 60 is mounted on one lateral side of the shell 40. A supporting foot 70 is mounted at a lateral side of the shell 40, and the other supporting foot 70' is provided on the ejecting member 60.

Figure 3:
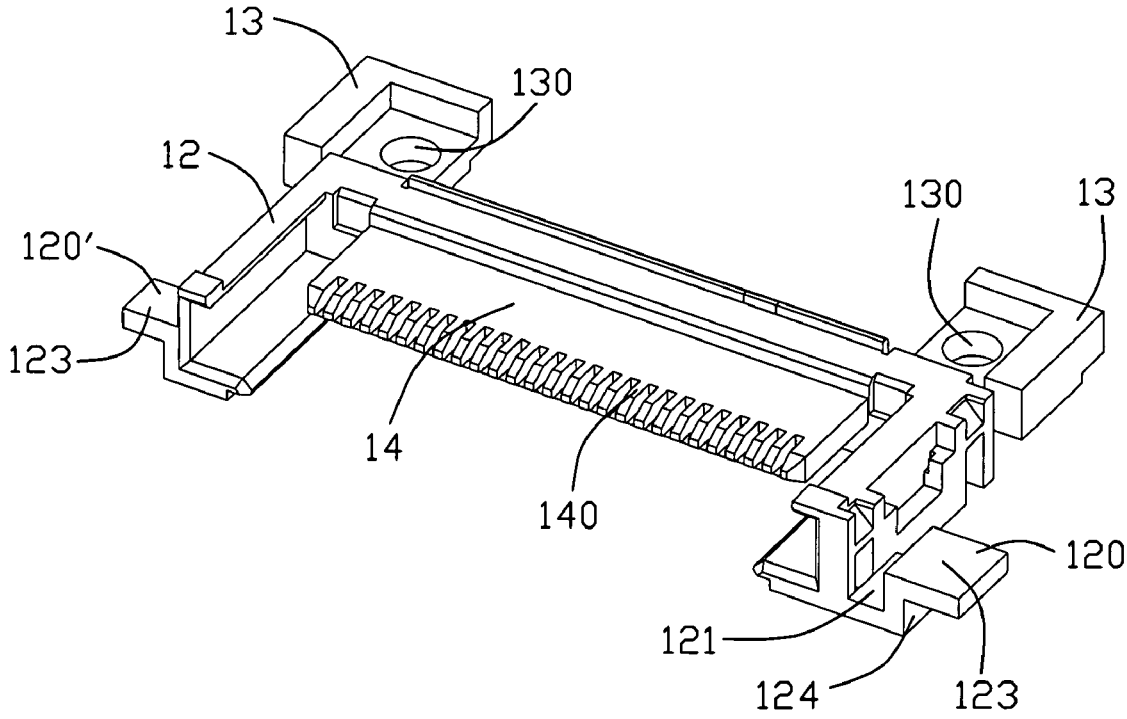
FIG. 3 is a perspective view of an insulating housing of the sinking electrical card connector.
Figure 4:
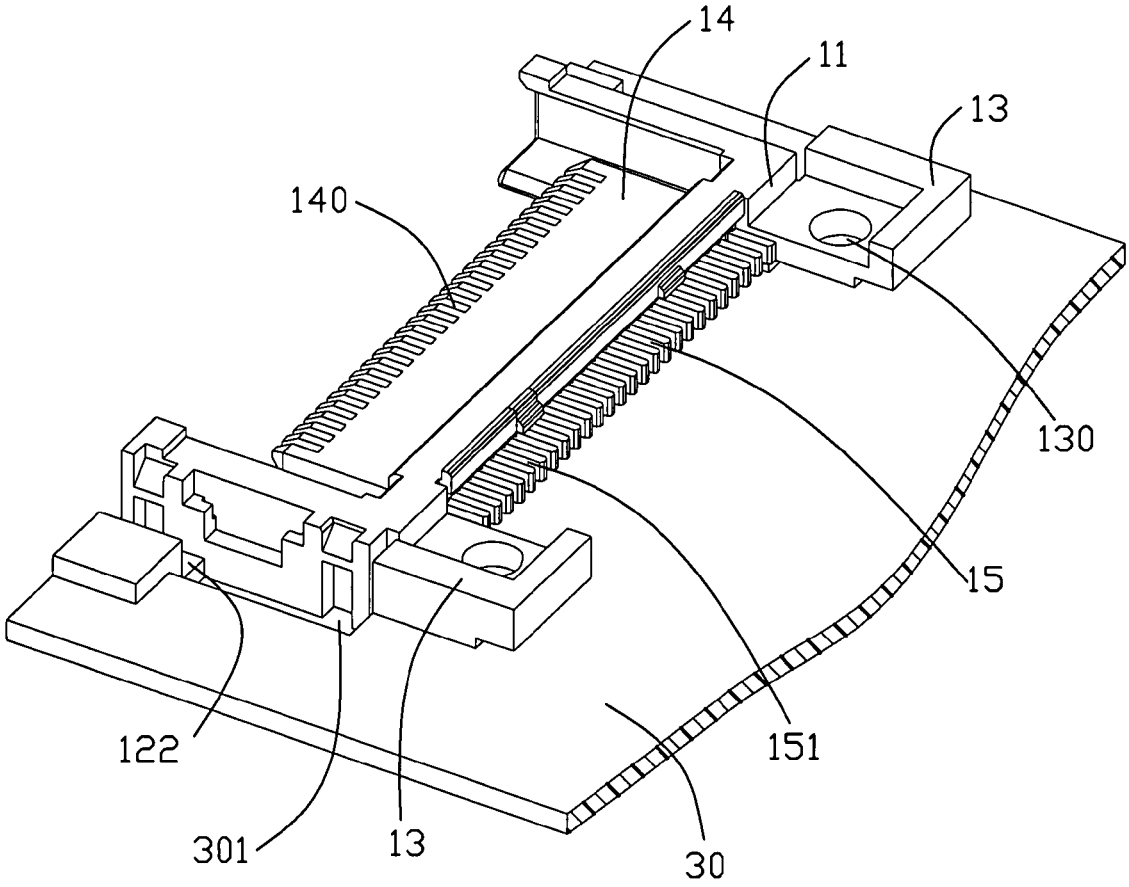
FIG. 4 is a perspective view of the insulating housing sinking partially in a hole of a Printed Circuit Board.

With respect to FIG. 2 to FIG. 4, the insulating housing 10, adapted for mounted on the PCB 30, is illustrated in following segments. The insulating housing 10 includes a base section 11, a pair of arms 12 extending from the opposite ends of the base section 11, a pair of setting sections 13 formed at the opposite heads of the insulating housing 10, and a tongue plate 14 extending from the base section in a front-to-back direction. The tongue plate 14 is located between the two arms 12 and defines a number of terminal passageways 140 for receiving the terminals 20. Each terminal 20 has an engaging portion 22 for contacting with a card pad electrically, a tail portion 24 for electrically connecting with PCB 30, and a middle portion 25 retained in the terminal passageways 140. The middle portion 25 connects the tail portion 24 and the engaging portion 22 together. By the base section 11 extending forwardly between the setting sections 13, a positioning portion 15 with a number of crossing grooves 151 is formed opposite to the tough plate 14. When the terminals 20 are received in the insulating housing 10, the terminals 20 extend along corresponding passageways 140 into corresponding crossing grooves 151 of the positioning portion 15. Each setting section 13 defines a screw hole 130 for a screw (not shown) going through.

Referring to the arms 12 of the insulating housing 10, a pair of holding portions 120 and 120' are formed by the outside walls of the arms 12 extending outwardly, respectively, for partially loading the sinking electrical card connector 100 in the hole of the PCB 30. The holding portion 120 includes a level section 121 extending horizontally from one arm 12, a vertical section 124 tending perpendicularly from the level section 121, and a supporting section 123 tending horizontally and outwardly from the vertical section 124. The bottom face of the level section 121 and the bottom face of the arm 12 are in a same level, additionally, the level section 121 and the vertical section 124 define a joining body (not labeled). Therefore, a groove 122 is defined between the joint body and one arm 12. The other holding portion 120' includes a vertical section (not labeled) jointing with the outside of the other arm 12, and a supporting section 123 extending horizontally from the vertical section, so there is not a groove defined therebetween. Each supporting section 123 of the holding portions 120 and 120' engages with the edge of the hole of the PCB 30, respectively.

As shown in FIG. 1 and FIG. 2, the shell 40, of which the insulating housing 10 is mounted at the head, defining, from a top view, generally a large rectangular configuration with a small rectangular notch (not labeled) configuration at a front corner beside said insulating housing 10, includes an L-shaped embody 41 and a number of side walls. These side walls extend downwardly from the embody 41 and include a front wall 42, a first side wall (not shown) extending along essentially a full length, a second side wall 45 opposite to the first side wall and extending with a portion of said full length due to said small rectangular notch, a third side wall 43 parallel and between the first side wall and the second side wall 45, and a transverse wall 46 located between the second side wall 45 and the third side wall 43. As described above, tending outwardly and upwardly from the third side wall 43, a channel 400 is defined. At the opposite sides of the front wall 42, there are a pair of board plates 421. Each board plate 421 has a board hole 422 for screws going through, corresponding to the screw holes 130 of the insulating housing 10.

Figure 5:
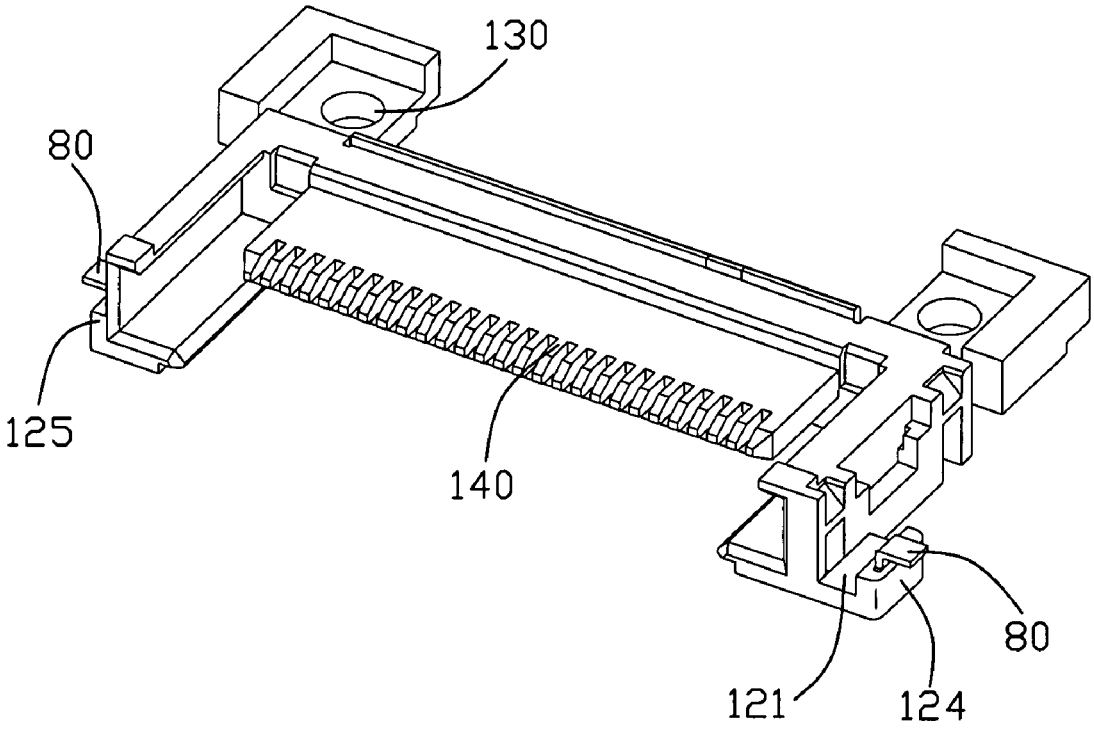
FIG. 5 is a perspective view of a replacer of the sinking electrical card connector.
Figure 6:
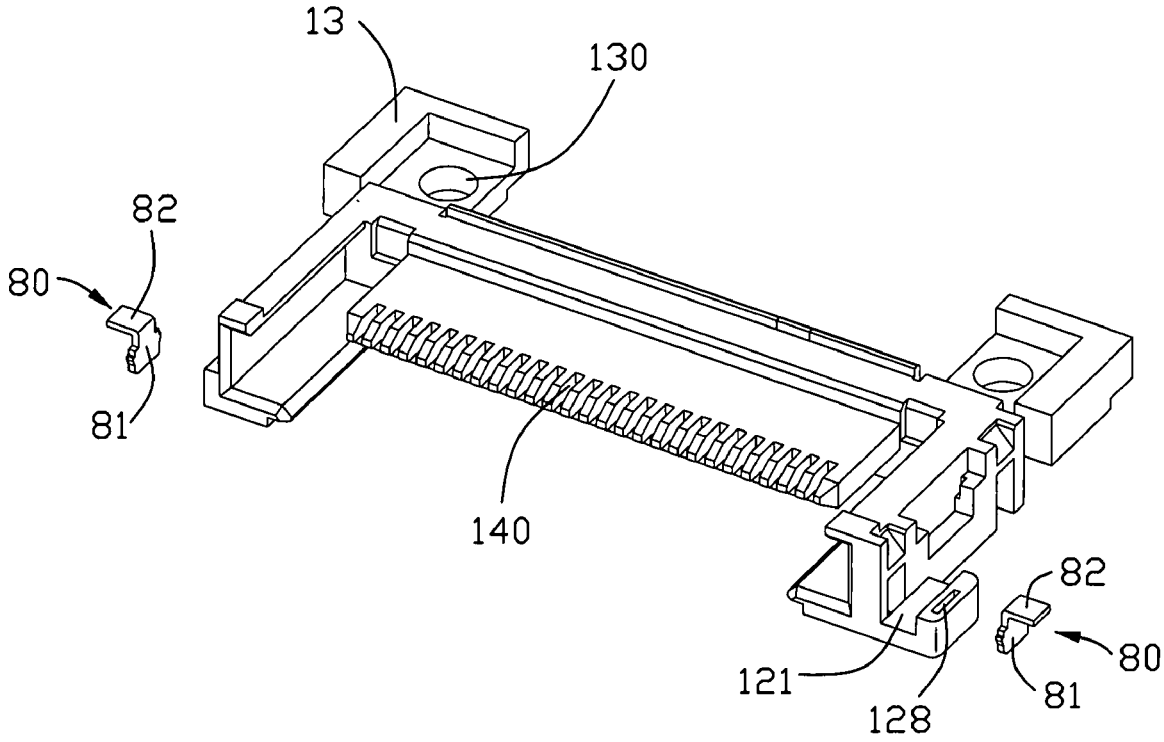
FIG. 6 is a perspective view of a pair of metallic plates and an insulating housing different from the insulating housing shown in FIG. 3.

The insulating housing 10 as described above, also can be changed as following. As shown in FIGS. 3, 5 and 6, the supporting sections 123 of the holding portions 120 and 120' are replaced by a pair of metallic plates 80. Each metallic plate 80 includes a fixing portion 81 and a metallic supporting portion 82. The fixing portions 81 are inserted into corresponding mounting slots 128 defined by the vertical portions 124 and 125, respectively. Otherwise, the holding portions 120 and 120' can be formed by metal material, and mounted on the lateral outside wall of the insulating housing 10.

The ejecting member 60, for ejecting the card from the receiving room, comprises a metal bracket 61, a pressing pole 62, a first projecting pole 63, a second projecting pole 64, a removal pole 65 joining the first projecting pole 63 with the second projecting pole 64 together, and a limiting portion (not shown) covered by the metal bracket 61. The second projecting pole 64, protruding into the receiving room through a pushing pole 641, is placed in the groove 122 and the channel 400 in a back-to-front direction. By pushing the pressing pole 62, the first projecting pole 63 and the second projecting pole 64 move subject to the removal pole 65 running around an axis, thereafter the card tends to be ejected by the pushing pole 641.

As described above, with the supporting sections 123 of the holding portions 120 and 120' loaded on the PCB 30, the barycenter of the insulating housing 10 is located between the supporting sections 123 and the tail portion 24 of the terminals 20, and the sinking electrical card connector 100 can be mounted stably, avoiding the insulating housing 10 deflect forwardly from the PCB 30. In another words, the invention can be desirable to make sure a sinking electrical card connector assembled with the PCB more stably, and make the terminals assembled with the PCB without more forward force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A sinking electrical card connector comprising:

an insulating housing sinking partially into a hole defined on a printed circuit board (PCB);

a at least one terminal is retained in the insulating housing;

a shell mounted on the insulating housing;

wherein a pair of holding portions extend outwardly from two opposite lateral walls of the insulating housing, and each holding portion engages with an edge of the hole of the PCB;

wherein one holding portion comprises a level section extending from one lateral wall of the insulating housing, a vertical section extending from the level section, and a supporting section extending horizontally from the vertical section and engaging with the edge of the hole.

2. The sinking electrical card connector as claimed in claim 1, a plurality of terminals are retained in the insulating housing.

3. The sinking electrical card connector as claimed in claim 2, wherein a groove is defined by the level section, the vertical section, and the outside wall of the insulating housing.

4. The sinking electrical card connector as claimed in claim 2, wherein the other holding portion has a supporting section extending horizontally from the other lateral wall of the insulating housing and engaging with the edge of the hole.

5. The sinking electrical card connector as claimed in claim 2, wherein the other holding portion comprises a vertical section jointing with the outside wall of the other lateral wall, and a supporting section extending horizontally from the vertical section and engaging with the edge of the hole.

6. The sinking electrical card connector as claimed in claim 5, wherein both of the supporting sections are a pair of metallic plates which are mounted on the corresponding vertical sections of the holding portions, respectively.

7. The sinking electrical card connector as claimed in claim 6, wherein each metallic plate comprises a fixing portion and a metallic supporting portion extending horizontally from the fixing portion.

8. The sinking electrical card connector as claimed in claim 7, wherein the fixing portion of each metallic plate is inserted into a mounting slot of the vertical section.

9. The sinking electrical card connector as claimed in claim 4, wherein the holding portions are formed by metal material.

10. The sinking electrical card connector as claimed in claim 1, wherein the insulating housing comprises a base section and a pair of arms extending from the opposite ends of the base section, and the holding portions are mounted on the outside walls of the arms, respectively.

11. A sinking electrical card connector comprising:

an insulating housing sinking partially into a hole defined on a printed circuit board (PCB);

a plurality of terminals retained in the insulating housing;

a shell mounted on the insulating housing;

wherein a pair of holding portions extend outwardly from two opposite lateral walls of the insulating housing, and each holding portion engages with an edge of the hole of the PCB;

wherein the insulating housing comprises a base section, a pair of arms extending from the opposite ends of the base section, and a tough plate extending backwardly from the base section between the arms.

12. The sinking electrical card connector as claimed in claim 11, further comprising a positioning portion formed beside the base section and extending forwardly opposite to the tough plate.

13. The sinking electrical card connector as claimed in claim 12, wherein the positioning portion has a plurality of crossing grooves, and each terminal extends along a corresponding passageway of the tough plate into the corresponding crossing groove.

14. A sinking electrical card connector comprising:

an insulating housing sinking partially into a hole defined on a printed circuit board (PCB);

a plurality of terminals retained in the insulating housing;

a shell mounted on the insulating housing;

wherein a pair of holding portions extend outwardly from two opposite lateral walls of the insulating housing, and each holding portion engages with an edge of the hole of the PCB;

wherein each holding portion has a supporting portion leveled higher than the bottom surface of the housing and a groove formed between the housing and the supporting portion.

15. The sinking electrical card connector as claimed in claim 14, further comprising an ejecting member mounted on a lateral side of the shell.

16. The sinking electrical card connector as claimed in claim 15, wherein the ejecting member comprises a projecting pole protruding into a receiving room defined by the shell and the insulating housing.

* * * * *